US011013088B2

(12) United States Patent
Lombardi et al.

(10) Patent No.: US 11,013,088 B2
(45) Date of Patent: May 18, 2021

(54) THREE-POSITION OPERATING MODE SWITCH

(71) Applicant: Google LLC, Mountain View, CA (US)

(72) Inventors: Michael J. Lombardi, Lake Zurich, IL (US); Mitchell Hodges, Plainfield, IL (US); Sajid Dalvi, Aurora, IL (US); Joe Allore, Mundelein, IL (US); Krzysztof Szot, Carol Stream, IL (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 16/119,188

(22) Filed: Aug. 31, 2018

(65) Prior Publication Data

US 2020/0077489 A1 Mar. 5, 2020

(51) Int. Cl.

| | |
|---|---|
| ***H01H 15/00*** | (2006.01) |
| ***H05B 47/10*** | (2020.01) |
| ***H01H 9/02*** | (2006.01) |
| ***H01H 47/00*** | (2006.01) |

(52) U.S. Cl.

CPC ..... *H05B 47/10* (2020.01); *H01H 9/02* (2013.01); *H01H 47/00* (2013.01); *H01H 15/00* (2013.01); *H01H 2235/01* (2013.01)

(58) Field of Classification Search

CPC .. H01H 13/702; H01H 13/785; H01H 13/703; H01H 2229/028; H01H 13/7006; H01H 25/002; H01H 13/85; H01H 13/20; H01H 2227/034; H01H 2215/028; H01H 2003/323; H01H 2231/008; H01H 2215/004; H01H 23/30; H01H 2300/01; H01H 23/145; H01H 19/635; H01H 21/24; H01H 15/10; H01H 15/04; H01H 15/02; H01H 15/102; H01H 15/16; H01H 15/14; H01H 15/20; H01H 1/36; A63F 13/24

See application file for complete search history.

(56) References Cited

U.S. PATENT DOCUMENTS

| | | | | |
|---|---|---|---|---|
| 2,991,343 A | | 7/1961 | Norden | |
| 3,192,329 A | | 6/1965 | Murrle | |
| 4,154,996 A | | 5/1979 | Arnold | |
| 4,296,394 A | * | 10/1981 | Ragheb | H01H 5/02 200/404 |
| 5,534,842 A | * | 7/1996 | Nagayama | H01H 9/102 337/402 |

(Continued)

OTHER PUBLICATIONS

International Search Report and Written Opinion for App No. PCT/US2019/039047, dated Jan. 31, 2020, 19 pages.

(Continued)

*Primary Examiner* — Ahmed M Saeed

(74) *Attorney, Agent, or Firm* — Butzel Long; Donald J. Lecher

(57) ABSTRACT

A modular electrical control system for installation in an electrical box of a premises includes a switch module configured to control power delivery to at least one external load, the switch module including a multi-position switch device that changes an operational mode of the switch module to off, toggle mode, or dimmer mode, and a removable user interface module configured to connect to the switch module, receive power from the switch module and display an interface in accordance with a setting of the multi-position switch device.

19 Claims, 13 Drawing Sheets

(56) References Cited

U.S. PATENT DOCUMENTS

| | | | | |
|---|---|---|---|---|
| 7,605,337 | B2 * | 10/2009 | Scherl | H01H 3/022 200/16 A |
| 2006/0180451 | A1 * | 8/2006 | Gass | B23D 59/001 200/334 |
| 2008/0308399 | A1 | 12/2008 | Hoshinaka | |
| 2014/0077707 | A1 * | 3/2014 | Restrepo | H05B 47/19 315/158 |

OTHER PUBLICATIONS

International Search Report and Written Opinion for PCT/US2019/039047, dated Jun. 26, 2020, 19 pages.

* cited by examiner

700

705

(A)

(B)

(C)

THREE-POSITION OPERATING MODE SWITCH

BACKGROUND

It will be appreciated that this Background section represents the observations of the inventors, which are provided simply as a research guide to the reader. As such, nothing in this Background section is intended to represent, or to fully describe, prior art.

Lighting controls remain one of the most common devices in the world. They are in nearly every country, in most homes and rooms. In addition to widespread use, the appearance and functionality of the basic light switch remains virtually identical to what was provided in the original disclosure of the toggle light switch in 1917. However, newer functions like dimming, motion-based activation and programmed lighting schedules have been implemented in various forms. Companies have also integrated modern connectivity solutions into the standard light switch, allowing it to be controlled remotely via smartphone or other electronic device.

Some lighting systems operate in a "toggle" mode, that is having only an ON or OFF state, while others can operate in a "dimmer" mode. In dimmer mode the amount of power delivered to the light can be controlled to brighten or dim the light.

BRIEF SUMMARY

According to an embodiment of the disclosed subject matter, a modular electrical control system for installation in an electrical box of a premises includes a switch module configured to control power delivery to at least one external load, the switch module including a multi-position switch device that changes an operational mode of the switch module to off, toggle mode, or dimmer mode, and a removable user interface module configured to connect to the switch module, receive power from the switch module and display an interface in accordance with a setting of the multi-position switch device.

According to an embodiment of the disclosed subject matter, a multi-position switch device, includes a first spring-loaded contact bar biased against a first set of contact pads, a second spring-loaded contact bar biased against a second set of contact pads, a first plunger disposed proximate to the first spring-loaded contact bar such that when the first plunger is depressed the first spring-loaded contact bar disengages from the first contact pads leaving an air gap between the first contact pads and the first contact bar, a second plunger disposed proximate to the second spring-loaded contact bar such that when the second plunger is depressed the second spring-loaded contact bar disengages from the second contact pads leaving an air gap between the second contact pads and the second spring-loaded contact bar, and a slidable switch, having a protrusion that depresses the first plunger when the switch passes into a first position, depresses the second plunger when the switch moves into a second position, and does not depress the first and second plunger when the switch moves into a third position.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Figure 1:
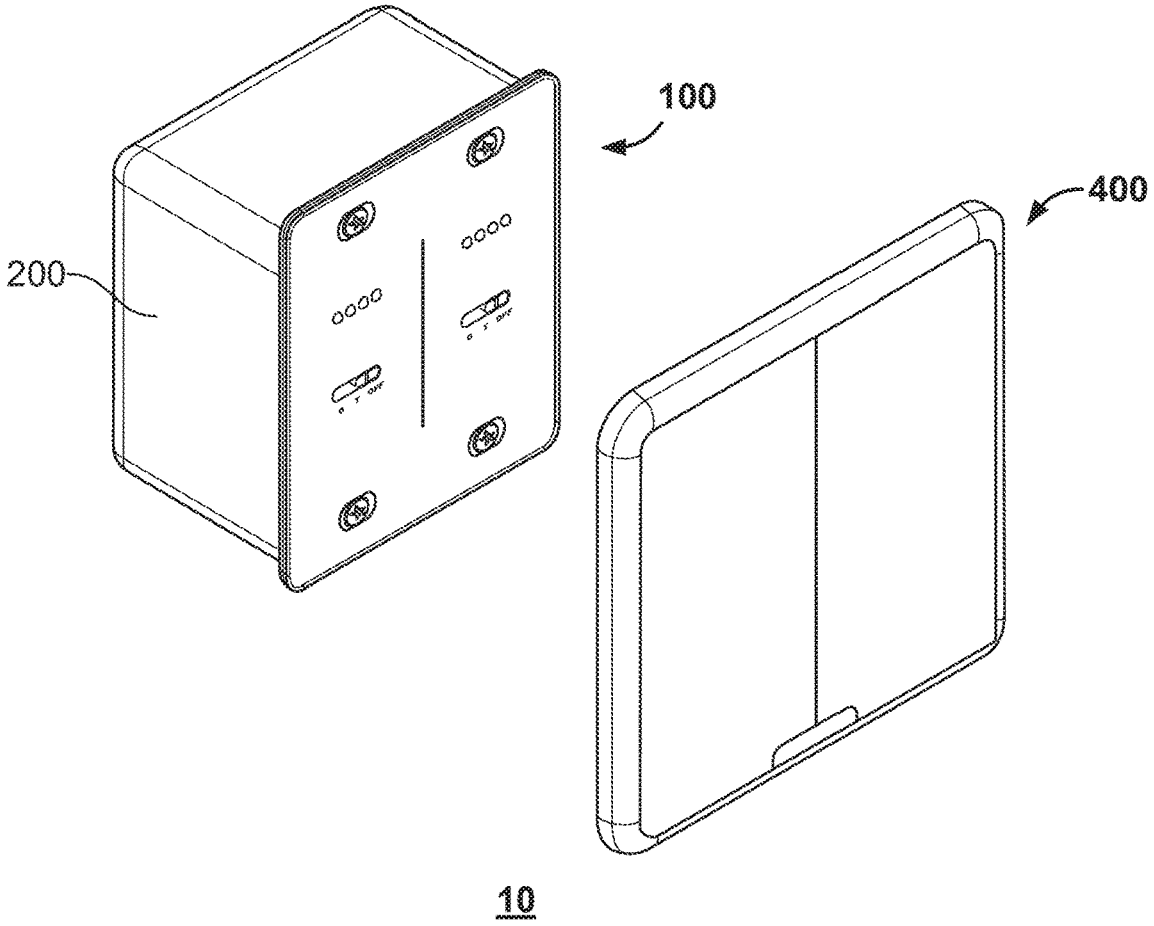
FIG. 1 shows a smart electrical control system according to an embodiment of the disclosed subject matter.

The following description is based on embodiments of the disclosed principles and should not be taken as limiting the claims with regard to alternative embodiments that are not explicitly described herein. Also, various aspects or features of this disclosure are described with reference to the drawings, wherein like reference numerals are used to refer to like elements throughout.

In this specification, numerous details are set forth in order to provide a thorough understanding of this disclosure. It should be understood, however, that certain aspects of disclosure may be practiced without these specific details, or with other methods, components, materials, etc. In other instances, well-known structures and devices are depicted in block diagram form to facilitate describing the subject disclosure.

Lighting controls are frequently found at the entry points of rooms within residential, commercial and industrial buildings. They are installed within switch boxes which are typically attached to the underlying structure of the building. Lighting controls have a standardized attachment scheme such that they can be installed, replaced and/or upgraded over time without modification to the switch box. Multiple lighting controls can control a single load, resulting in three-way or multi-way switch configurations.

A traditional simple light switch is essentially a mechanical switch device that does not require a power source to operate and operates solely in a toggle mode. Likewise, a traditional dimmer switch is normally implemented as a mechanical knob or sliding lever that can be used to adjust a variable resistor that controls a triode for alternating current (TRIAC).

Dimmer products must include a user-accessible air gap disconnect mechanism to comply with regulatory requirements (such as UL 1472). Dimmer products are typically rated for lower power (400 W, 600 W, 1000 W) than toggle products (1500 W, 1800 W). For a switch to be wired to a U.S. residential outlet, it must be a toggle switch rated to 1800 W (15 A) since the outlet is rated to 15 A. Thus, a conventional smart dimmer switch would not be compatible with an outlet. On the other hand, a toggle-only smart switch could never dim lights. The disclosed embodiments provide both modes of operation in a single switch, thereby reducing the number of products that need to be manufactured and increasing consumer flexibility to install switches anywhere in a home.

The disclosed embodiment of a smart electrical control system includes a three-position operating switch that complies with regulatory requirements and allows switching between dimmer and toggle modes. The disclosed smart electrical control system includes an in-wall light switch module and a user interface module that attaches and electrically connects to the switch module. The switch module can function in a dimmer mode or toggle mode. Various features described with respect to the embodiments of the disclosed smart electrical control system may be omitted or included in different combinations than depicted/described in the examples discussed below.

FIG. 1 depicts an embodiment of a smart electrical control system 10 according to the disclosed subject matter, including a switch box 200 housing a switch module 100 that draws power for the system 10 and implements switch functionality, and a user interface (UI) module 400 to provide a user with an interface to control the system 10. The configuration depicted is a dual-gang (two circuit) configuration, however, the switch module 100 and UI module 400 can be made in various configurations to accommodate different size and feature requirements.

Figure 2:
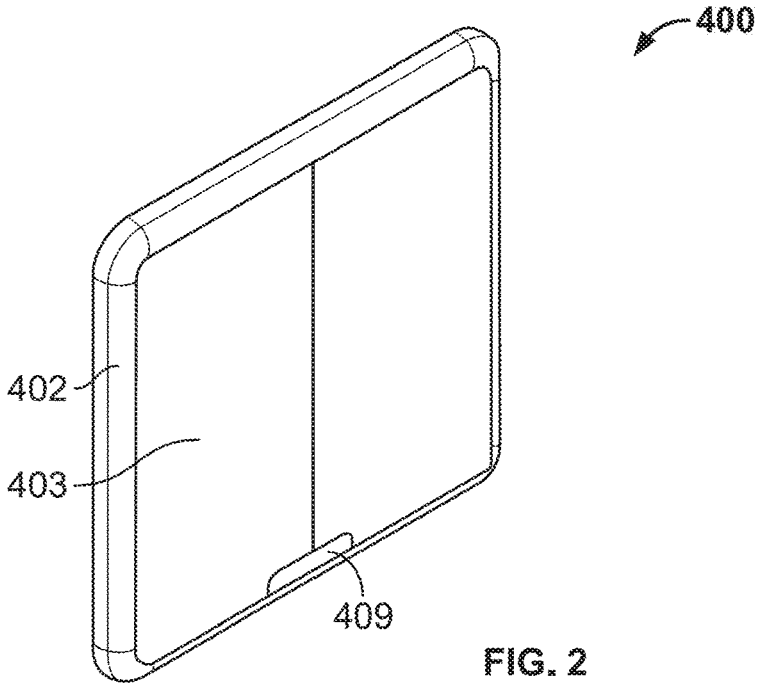
FIG. 2 shows an angled view of a user interface module according to an embodiment of the disclosed subject matter.

FIG. 2 is an angled view of a UI module 400 according to the disclosed subject matter. The UI module includes a lens 403 and front housing 402. A sensor lens 409 is included in this embodiment. As will be described below, the UI module 400 provides controls for smart switch functionality based on a mode (e.g., toggle/dimmer) that the smart electrical control system 10 is set in.

Figure 3:
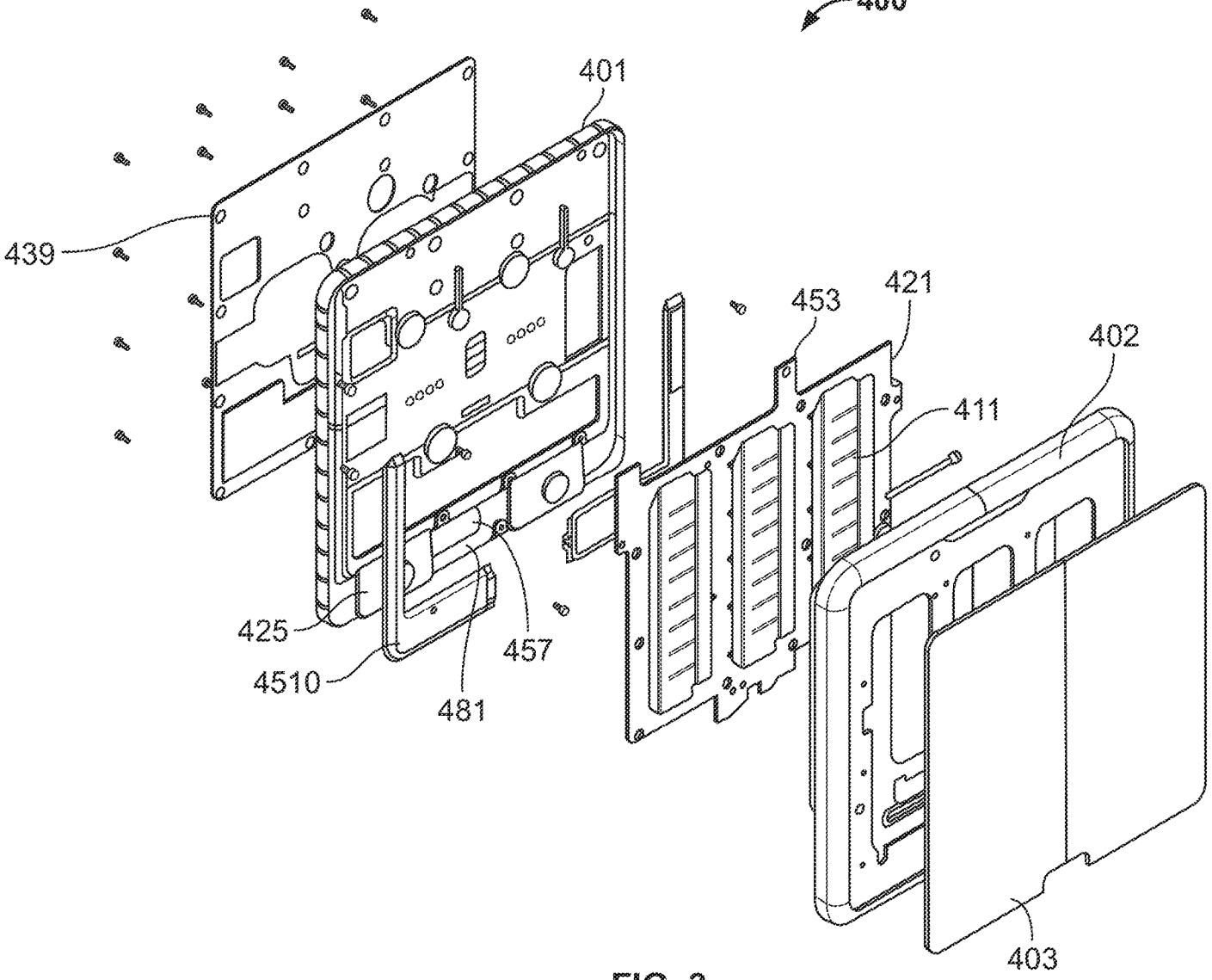
FIG. 3 shows an exploded, angled view of a user interface module from the front according to an embodiment of the disclosed subject matter.

FIG. 3 is an exploded, angled view of an embodiment of the UI module 400 from the front and illustrates an example layout of some of its powered internal components. In this layout an infrared (IR) motion sensor 457 is oriented towards a mirror 481 to direct the light from the sensor lens 409 (FIG. 2) towards the IR motion sensor 457. One or more speakers 425 may be located within an acoustic housing 4510 and connected to a printed circuit board (PCB) assembly 421, which includes a processor and various controllers. The PCB assembly 421 can include a microphone 453. The PCB assembly 421 also may include, beneath a light guide assembly 411, a plurality of LEDs (not depicted) to provide output and a plurality of touch sensors (not depicted) to receive input. To diffuse the light emitted by the LEDs, the light guide assembly 411 can be implemented as molded plastic, film sheets, or the like. A rear cover 439 attaches to the rear housing 401.

The UI module 400 can display an interface for smart switch functionality in various modes, such as toggle mode or dimmer mode. For example, the PCB assembly 421 can control the LED's to display lighting through the light guide assembly 411 according to a current mode setting and thereby indicate a state of the load (e.g. a current light setting, fan setting, etc), or provide other audio/visual information to a user. The lens 403 can include a printed layer such as an additional masked pattern that allows light to be emitted only in certain areas, for example to aid in creating a display suitable for a given mode.

Figure 4:
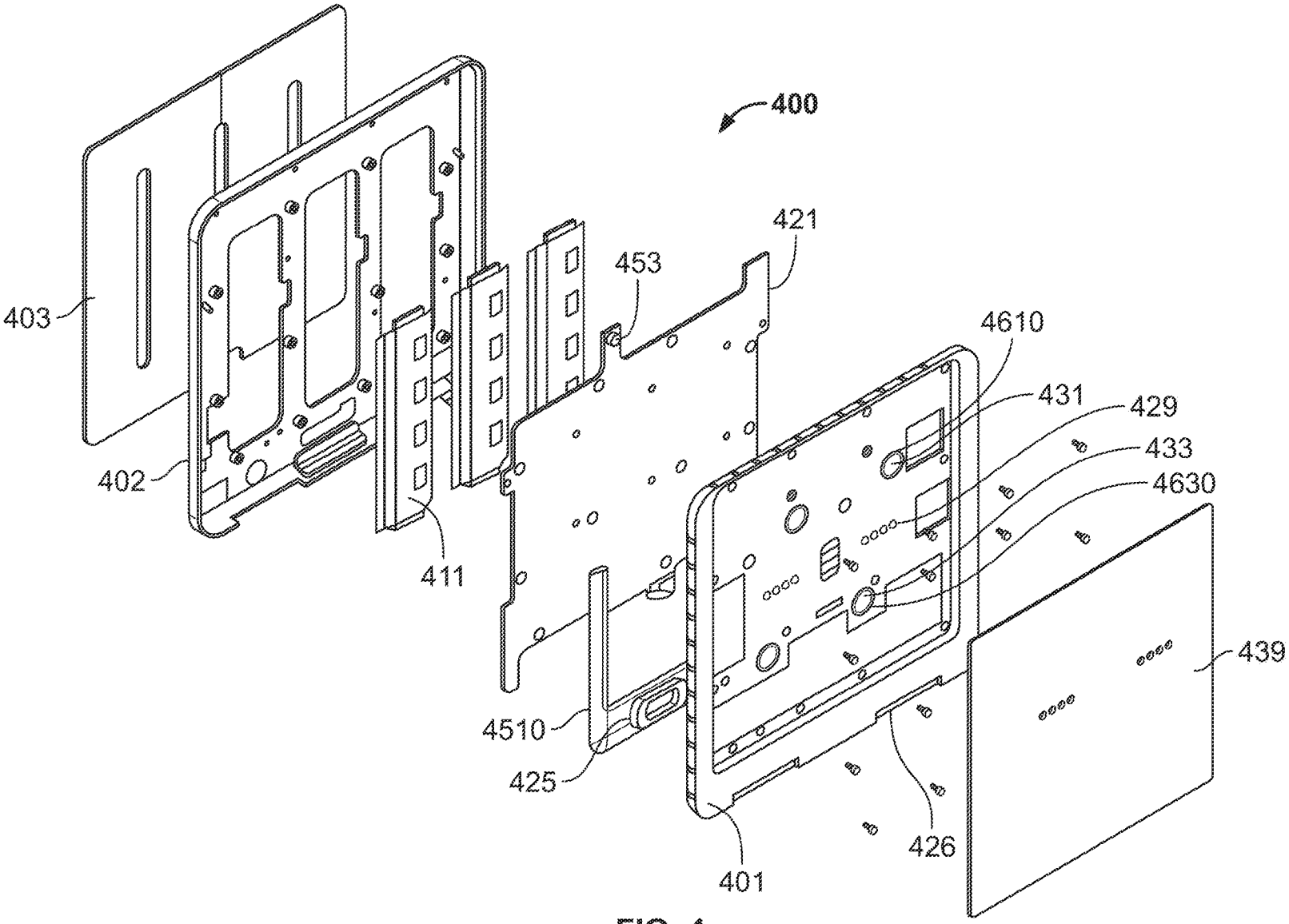
FIG. 4 shows an exploded view of a user interface module from the rear according to an embodiment of the disclosed subject matter.

FIG. 4 is an exploded, angled view of an embodiment of the UI module 400 from the rear, depicting an example layout of various components that interact with the switch module 100 (FIG. 1). The UI module 400 includes a mechanism for attaching or fastening to an underlying switch module 100. The mechanism can be implemented, for example, via magnets, hooks, slots, clips or other types of fasteners. As will be described below, the UI module can also include a data transmission system to communicate with the switch module, for example, pins or a transceiver, an IR light emitter and IR light detector or the like, and a power transmission system to supply power to or receive power from a switch module.

The embodiment depicted in FIG. 4 includes contact pins 429 to receive/transmit power and transmit/receive data, and retention magnets 431, 433 surrounded by ferrous steel shrouds 4610, 4630 to attach to the switch module 100. One or more audio ports 426 can be formed in the rear housing 401.

The UI module 400 is not limited to the embodiments or component layouts depicted in FIGS. 3-4, but can also be constructed with different layouts and include other sensors, for example, to detect temperature, humidity, ambient light, motion, and so on. In one embodiment, a UI module 400 can include one or more of a video camera, LCD display, ambient light sensor, and IR motion sensor.

Figure 5:
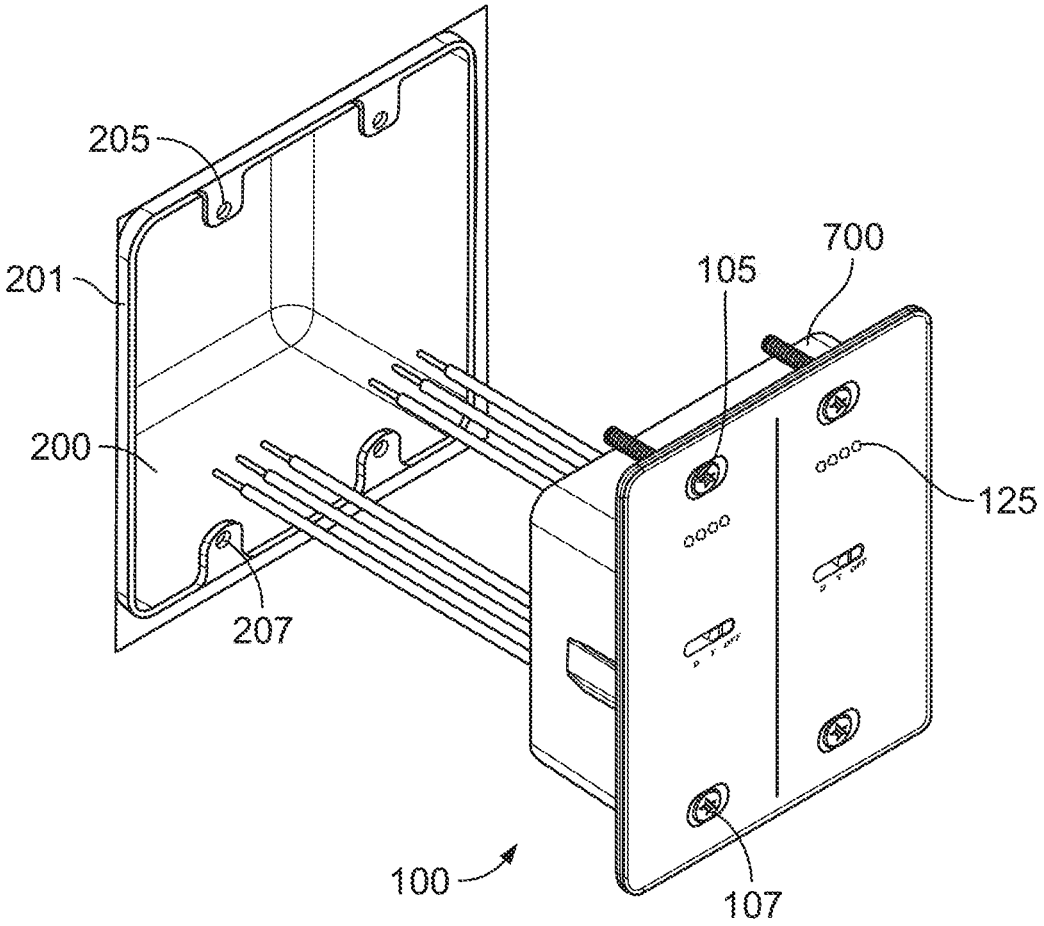
FIG. 5 shows an exploded view of a switch module according to an embodiment of the disclosed subject matter.

Turning now to details of the disclosed switch module 100, FIG. 5 depicts an angled, exploded view of a switch module 100 assembly in switch box 200. The switch box 200 has threaded holes, e.g., 205, 207 to retain the switch module 100 using screws, e.g., 105, 107. In typical applications the switch box 200 is surrounded by building material 201 such as drywall. In the embodiment depicted, the switch module 100 is installed into a dual gang switch box 200. The switch module 100 includes contact pins 125 which may transmit power to the UI module 400 and receive data signals from the UI module 400.

Figure 6:
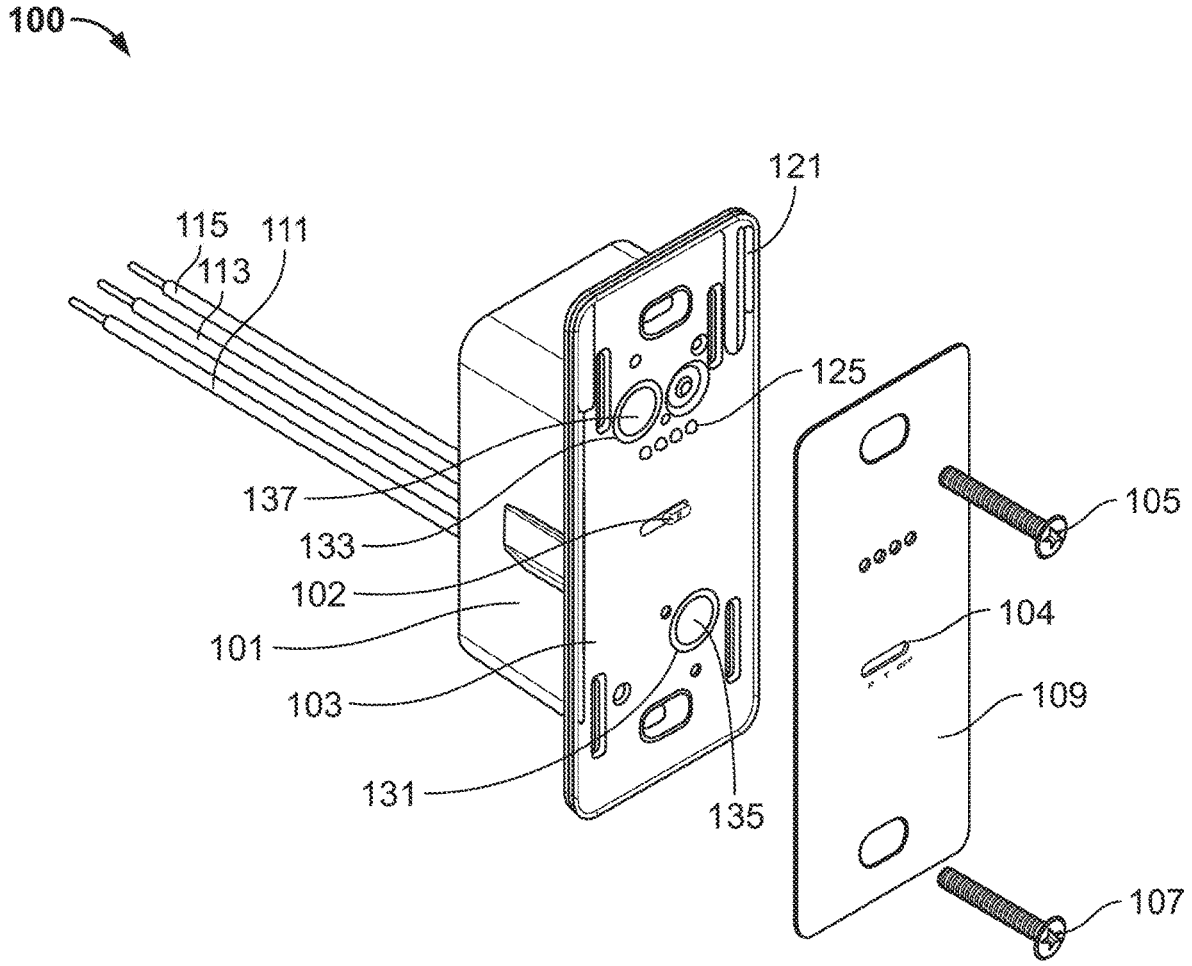
FIG. 6 shows another exploded view of a switch module according to an embodiment of the disclosed subject matter.

FIG. 6 is an angled, exploded view of a switch module 100 in a single-gang configuration. A first screw 105 and second screw 107 are used to retain the switch module 100 to a switch box. The switch module 100 includes front cover 109, front housing 103, and a main housing 101 that holds most of the internal components of the switch module 100, including a printed circuit board PCB assembly (not shown). The layout and configuration of the PCB and internal components can change based on the implementation of different features.

The switch module 100 incudes a plurality of connectors 111, 113, 115 for connecting the switch module 100 to a building's existing electrical wiring, e.g., through a gang box. The connectors 111, 113, 115 allow the switch module 100 to draw electrical power from the building and to execute switching functionality for the load (e.g., light, fan, etc.) that the switch module 100 is installed to control.

In the main housing 101, the switch module 100 can include a power transmission system to transmit power to the UI 400, for example, using contacts or a wireless power transmission coil. The embodiment depicted in FIG. 6 includes contact pins 125 configured to transmit power to a UI module (not shown) when attached the UI module.

The switch module 100 includes an antenna 121 disposed behind the front cover 109 to allow wireless communication with external electronic devices, e.g., smart phones, tablets, laptops, smart watches, etc. The antenna also can be used by one switch module to communicate with another switch module, for example, using wireless networking standards such as IEEE 802.15.4, which higher level protocols such as ZigBee and Thread are based on. Thus, multiple switch modules throughout a home can communicate with each other. In other embodiments, the switch module may offer no wireless connectivity and such connectivity may be included in the UI module.

Instead of peer-to-peer or one-to-many network topologies, a plurality of switch modules installed in a home may form a mesh network such that a single point of failure does not impact connectivity for other devices in the home. When a UI module 400 physically docks over a switch module 100 that is connected to the wireless mesh, the UI module 400 can use the contact pins 125 to communicate with the underlying switch module 100 and send commands and/or data through the mesh network instead of directly joining the wireless mesh. Using this configuration a UI module 400 can control any switch module on the mesh network and is not limited to controlling a switch module physically connected to the UI module.

Referring back to FIG. 6, the switch module 100 can also include a mechanism for attaching or fastening to the UI module, for example, magnets, hooks, slots, clips or other types of fasteners. In the embodiment depicted, two magnets 135, 137 are disposed behind the front cover 109, surrounded by two ferrous steel shrouds 131, 133 on all sides other than the side facing the front cover 109. The magnets 135, 137 can passively maintain a force that can be used to hold a UI module against the switch module 100, providing an additional advantage of reducing the number of parts that require interlocking or clicking that are susceptible to wear and tear.

The switch module 100 can also include a data transmission system, for example, contact pins, a transceiver, an infrared (IR) light emitter and IR light detector or the like. In one embodiment, the IR light emitter and IR light detector on the switch module 100 may be part of the same physical component. In the embodiment depicted in FIG. 6 contact pins 125 protrude through the front cover 103 and function as a data transmission system.

The switch module 100 itself can also implement a tactile switch (not shown) such that if a user presses on a front face of the switch module 100 the tactile switch will actuate and trigger an input to control a load, such as a light or fan, or trigger execution of an operation on a different device, such as turn on/off a radio. An indicator can be included on the front cover 109 to show a region for the user to press to actuate the switch module.

The switch module 100 also includes a slidable switch 102 disposed behind the front cover 109. The slidable switch 102 is accessible through opening 104 in the front cover 109.

Figure 7:
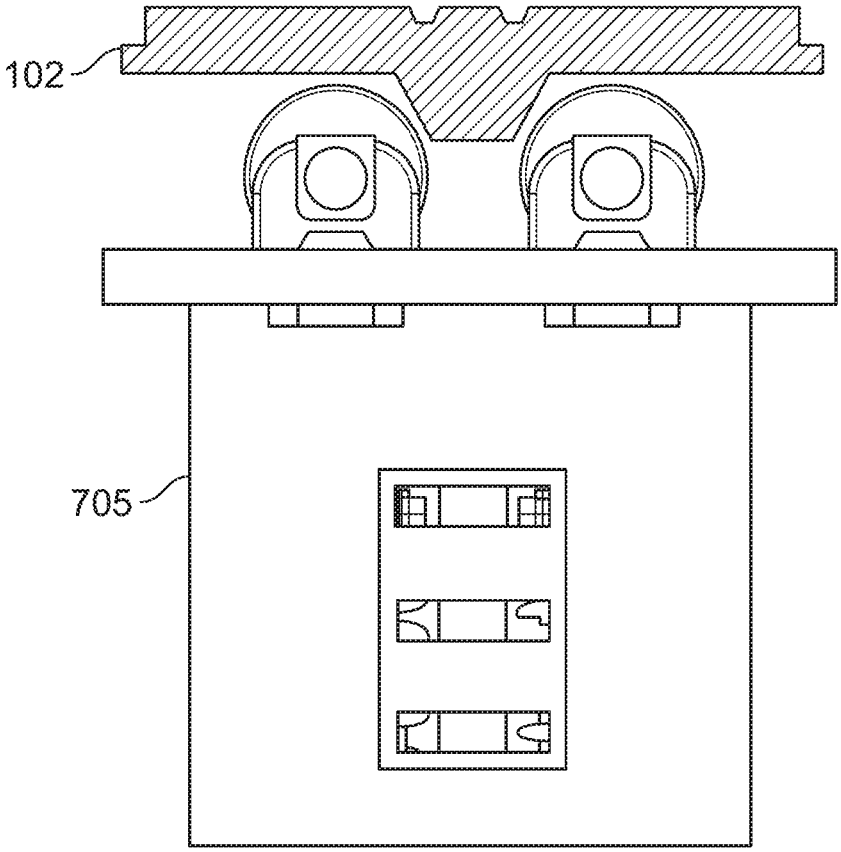
FIG. 7 shows a side view of a multi-position switch device according to an embodiment of the disclosed subject matter.

The slidable switch 102 enables a user to control the switch module 100 to implement various operating modes, such as dimmer (TRIAC-based) or toggle (relay-based) operation modes. FIG. 7 shows a side view of switch assembly 700 removed from the switch module 100. The switch assembly 700 includes a contact assembly 705 and the slidable switch 102.

Figure 8:
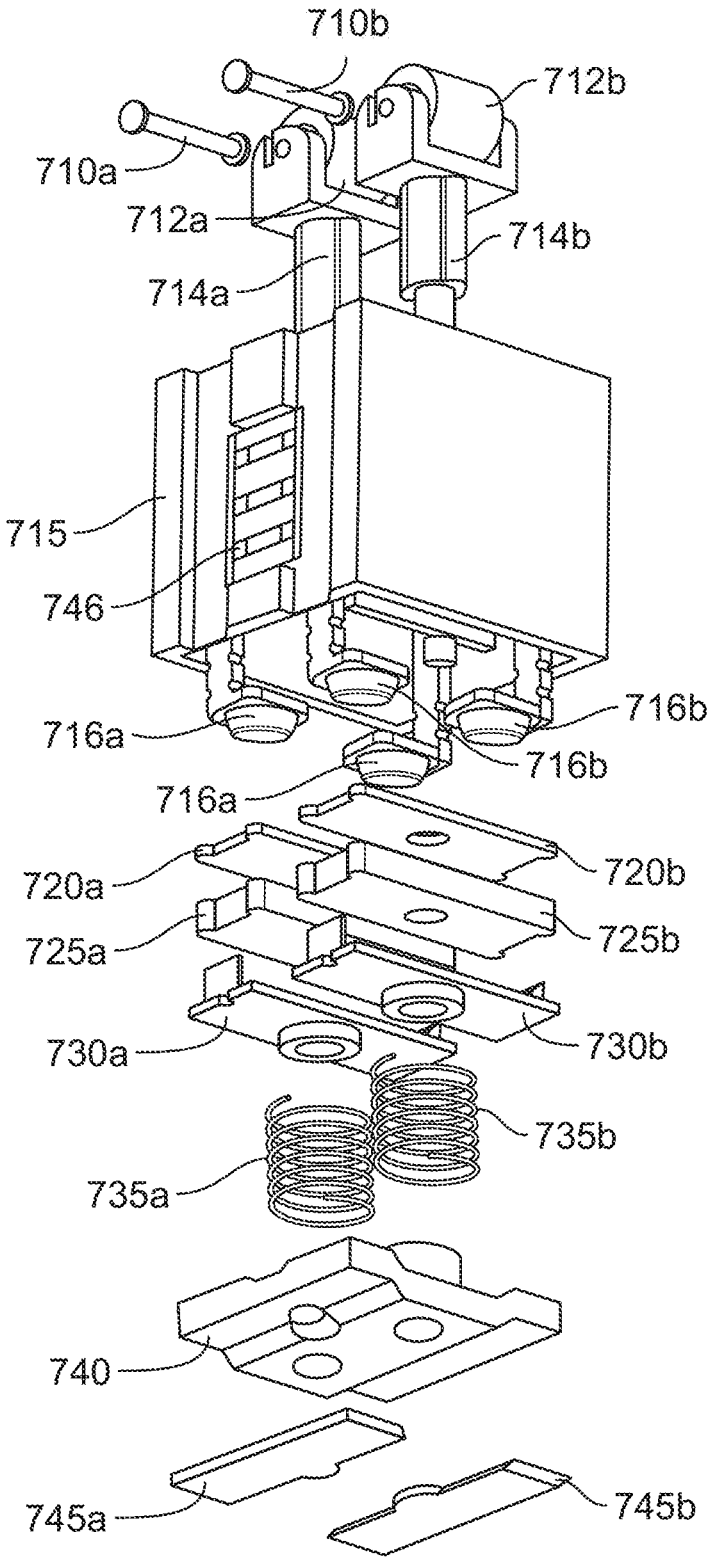
FIG. 8 shows an exploded view of a multi-position switch device according to an embodiment of the disclosed subject matter.

FIG. 8 shows an exploded view of the contact assembly 705, including: pins 710*a* and 710*b*, wheels 712*a* and 712*b*, plungers 714*a* and 714*b*, housing 715, contact pads 716*a* and 716*b*, contact bars 725*a* and 725*b*, insulators 730*a* and 730*b*, springs 735*a* and 735*b*, cover 740, and glue layers 745*a* and 745*b*. The contact assembly 705 can also include conductor layers 720*a* and 720*b* to lower contact resistance for the electrical path, thereby lowering heat produced by electrical current. The conductor layers 720*a* and 720*b* can be formed, for example, from AgSnO2.

The contact pads 716*a*, 716*b*, and the plungers 714*a*, 714*b* are disposed within housing 715 while the wheels 712*a*, 712*b* protrude out of a first side of the housing 715. The housing 715 can include a plurality of holes 746 that release heat which may accumulate in the housing 715. As will be described below, contact bars 725*a*, 725*b* and contact pads 716*a*, 716*b* form two independent switches that are opened or closed based on a position of the slidable switch 102 (FIG. 7).

Figure 9A:
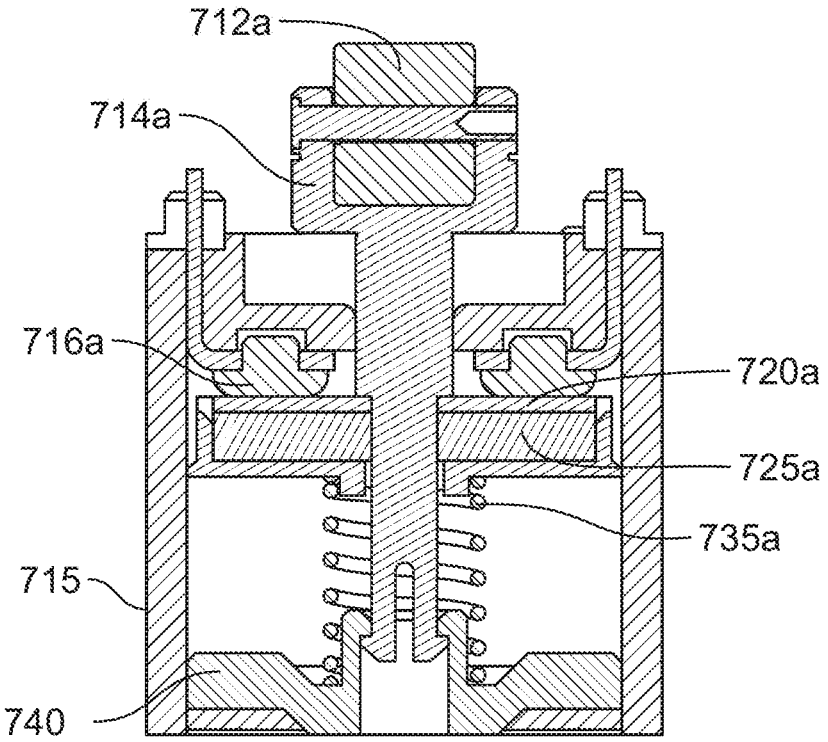
FIG. 9A shows a cut-away side view of a multi-position switch device according to an embodiment of the disclosed subject matter in a default position.

FIG. 9A shows a cut-away side view of the contact assembly in a default (closed switch) position. The spring 735*a* biases the contact bar 725*a*/conductor layer 720*a* against the contact pads 716*a* while in the default position. The depicted side view shows only half of the contact assembly. It should be understood that the full contact assembly includes a first pair of contact pads 716*a* which are shown biased against a first contact bar 725*a* in FIG. 9A, and a second pair of contact pads 716*b* (not shown) that may be biased against a second contact bar 725*b* (not shown) or separated from the second contact bar 725*b* (not shown) depending on the position of the plunger 714*b* (not shown). The position of plunger 714*b* (not shown) is independent of the position of plunger 714*a*.

Figure 9B:
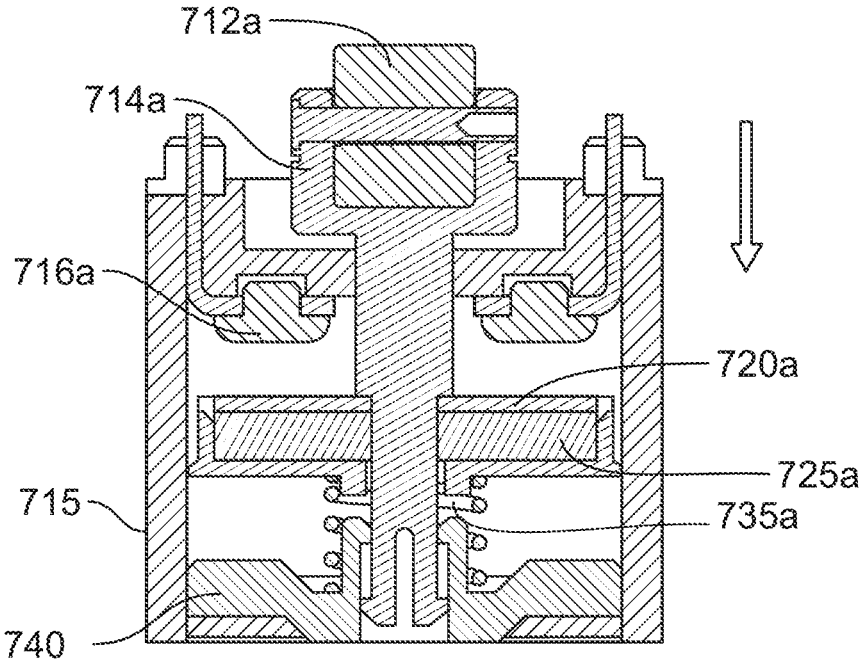
FIG. 9B shows a cut-away side view of a multi-position switch device according to an embodiment of the disclosed subject matter in a depressed position.

FIG. 9B shows a cut-away side view of the contact assembly in the depressed (open switch) position. A force at least partially in the direction of the arrow has been applied to wheel 712*a*, which presses the plunger 714*a* to separate the contact bar 725*a*/conductor layer 720*a* from the contact pads 716*a*, compress the spring 735*a*, and thereby place the contact assembly 705 in the depressed position. As can be seen in the figure, an air-gap now exists between the contact bar 725*a*/conductor layer 720*a* and the contact pads 716*a*.

FIG. 9B depicts only half of the contact assembly 705. It should be understood that the contact assembly 705 includes: 1) a first plunger 714*a* proximate to a first contact bar 725*a*/conductor layer 720*a* and having notches that contact the first contact bar 725*a*/conductor layer 720*a* such that when the first plunger 714*a* is depressed it forces the first contact bar 725*a*/conductor layer 720*a* to disengage from the first pair of contact pads 716*a*, leaving an air gap between the first contact pads 716*a* and the first contact bar 725*a*/conductor layer 720*a*; and 2) a second plunger 714*b* proximate to a second contact bar 725*b*/conductor layer 720*b* and having notches that contact the second contact bar 725*b*/conductor layer 720*b* such that when the second plunger 714*b* is depressed it forces the second contact bar 725*b*/conductor layer 720*b* to disengage from the second pair of contact pads 716*b*, leaving an air gap between the second contact pads 716*b* and the second contact bar 725*b*/conductor layer 720*b*.

As shown in FIG. 8, the contact assembly 705 includes wheels 712*a*, 712*b* that can each be individually depressed to open a respective switch. The wheels 712*a*, 712*b* are each attached on a distal end portion of the first and second plungers 714*a*, 714*b* opposite the contact pads 716*a*, 716*b* such that a protrusion on the slidable switch 102 can engage each wheel 712*a*, 712*b* and causes the wheel to turn as the switch moves into or out of the first or second position.

Figure 10:
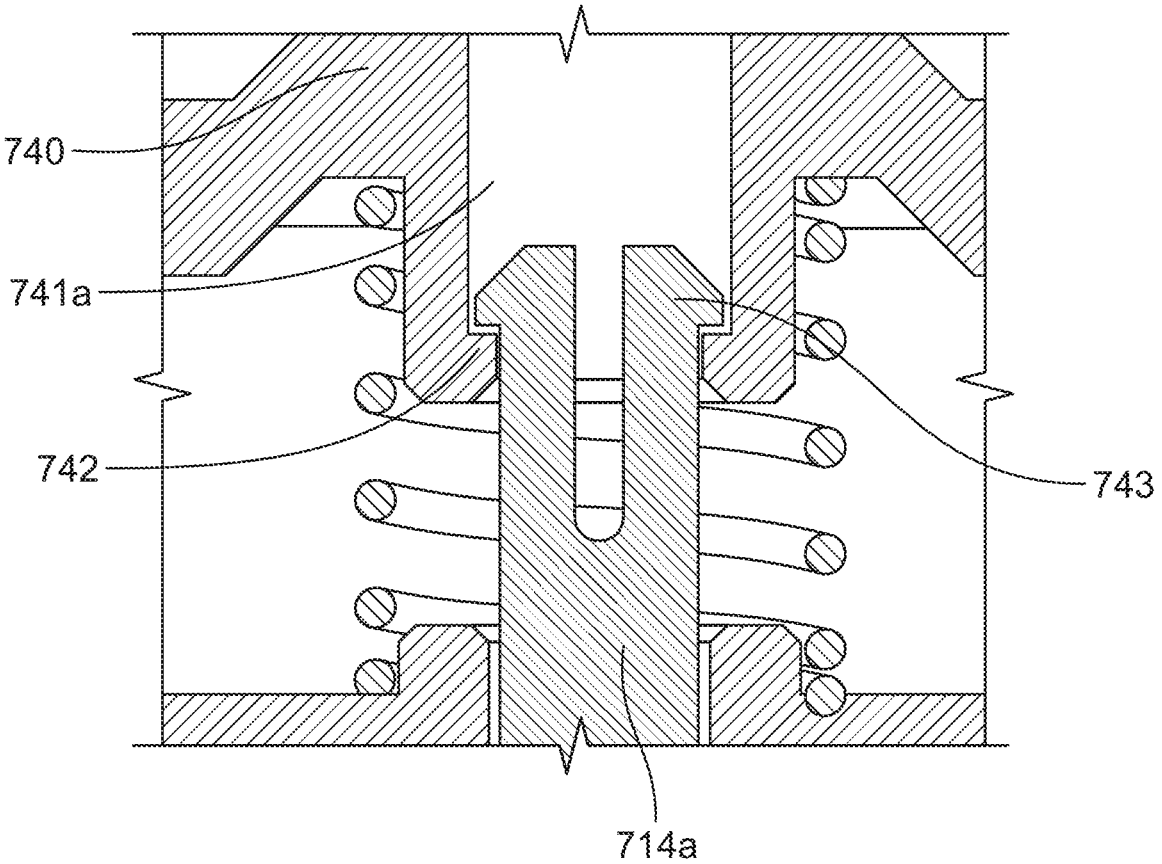
FIG. 10 shows a close-up cut-away view of the intersection of a plunger and channel according to an embodiment of the disclosed subject matter in a default position.

The cover 740 includes a first channel and a second channel that receives the first and second plungers 714*a*, 714*b*. FIG. 10 shows a close-up cut-away view of the intersection of the plunger 714*a*, the cover 740 and the channel 741*a*. The channel 741*a* includes an edge portion 742 that extends inward and engages extension portions 743 on the plunger 714*a* to prevent the plunger 714*a* from exiting the channel in a first direction. It should be understood that the cover 740 includes a second channel 741*b* that is similarly constructed to engage with plunger 714*b*.

Figure 11:
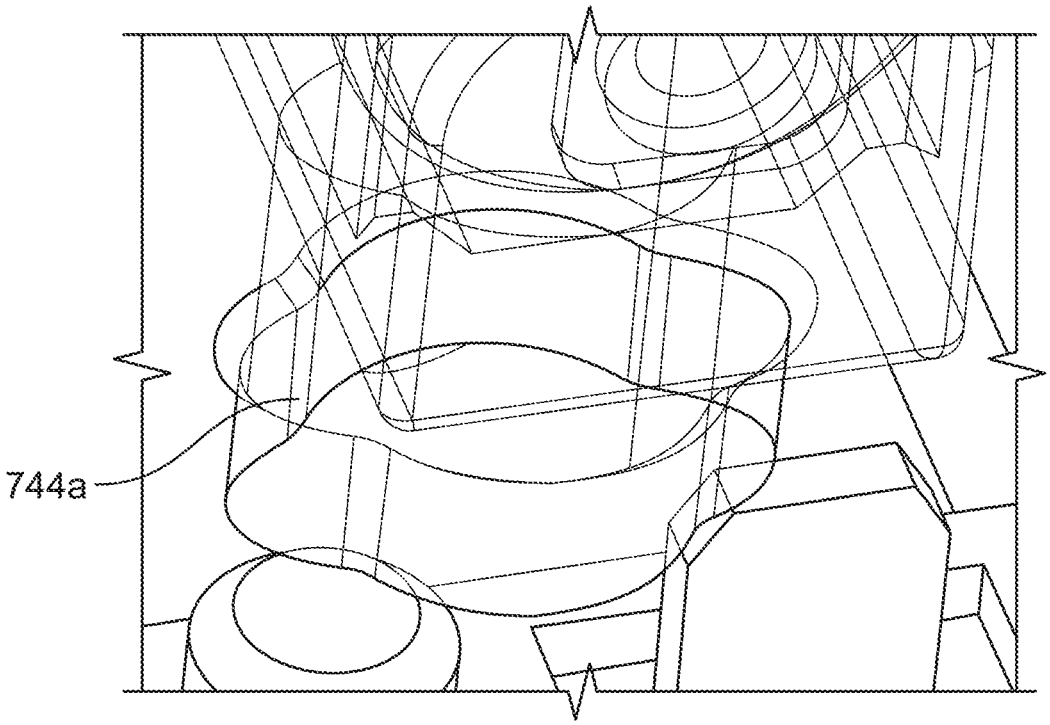
FIG. 11 shows a close-up internal view of a housing according to an embodiment of the disclosed subject matter in a default position.

FIG. 11 shows a close-up internal view an embodiment of the side of the housing 715 (FIG. 8) that is opposite cover 740 (FIG. 8). The side of the housing depicted in FIG. 11 includes a first opening 744*a* through which the first plunger 714*a* passes, and a second similar opening (not depicted) through which the second plunger 714*b* passes. The opening 744*a* is formed in a shape that conforms with a shape of a portion of the plunger 714*a*. In one embodiment, the shape has a design that prevents the plunger 714*a* from rotating as it passes through the opening 744*a*.

Figure 12:
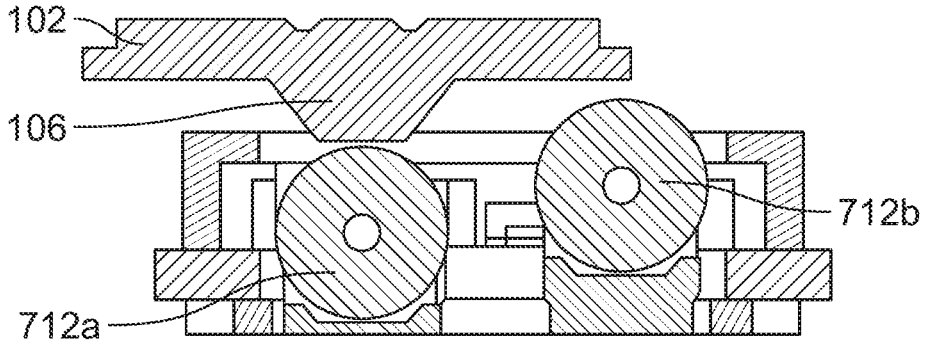
FIG. 12 shows various states of a slidable switch and multi-position switch device according to an embodiment of the disclosed subject matter.
Figure 12:
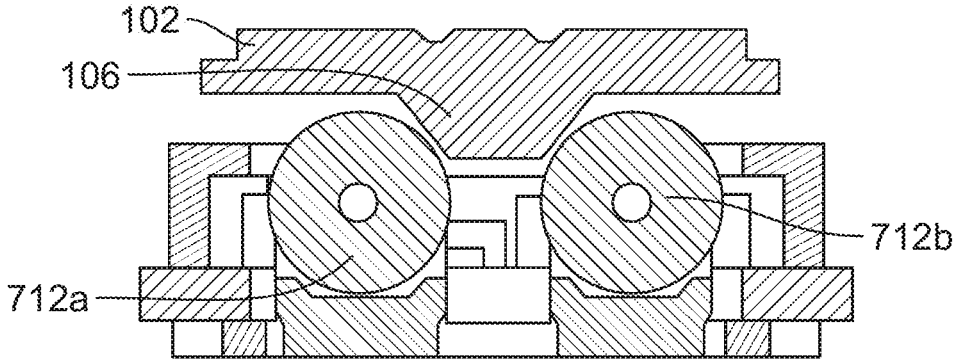
Figure 12:
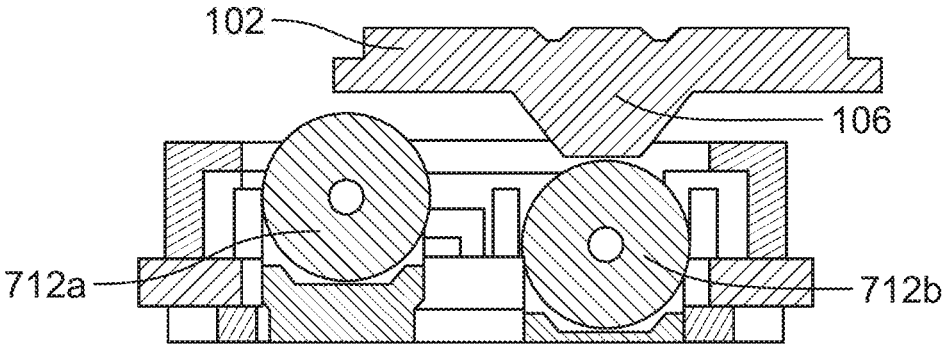

FIG. 12 depicts three possible states that the contact assembly 705 can be set in based on the position of the slidable switch 102. In each position the protrusion 106 from the slidable switch 102 sets that state of the switch assembly 100 by depressing one of or neither of the wheels 712*a*, 712*b*. That is, the protrusion 106 depresses the first plunger 714*a* when the slidable switch 102 passes into a first position, depresses the second plunger 714*b* when the slidable switch 102 moves into a second position, and disengages from the first and second plungers 714*a*, 714*b* when the slidable switch 102 moves into a third position.

More specifically, in position (A) the slidable switch 102 is placed in a position in which the protrusion 106 depresses wheel 712*a*, which in turn opens the contacts of the corresponding switch (i.e., as shown in FIG. 9B). In position (A) the slidable switch 102 does not depress wheel 712*b*, which therefore remains in a default position with its corresponding switch contacts closed (i.e., as shown in FIG. 9A).

In position (B) the slidable switch 102 is placed in a position in which the protrusion 106 does not depress either of wheels 712*a* or 712*b*. Both corresponding switch contacts therefore remain closed by default.

In position (C) the slidable switch 102 is placed in a position in which the protrusion 106 depresses wheel 712*b*, which in turn opens the contacts of the corresponding switch. In position (C) the slidable switch 102 does not depress wheel 712*a*, which remains in a default position with its corresponding switch contacts closed.

As shown in FIG. 6, the disclosed switch assembly can be installed as part of a switch module 100 that can operate in either a toggle mode or a dimmer mode. Depending on the installation setup, the terminals to connectors 111, 113, and 115 can facilitate different types of controls. In one embodiment the connectors 111, 113, and 115 are connected to a common terminal and two traveler terminals, allowing execution of multiple switch functions as will be described below.

Figure 13:
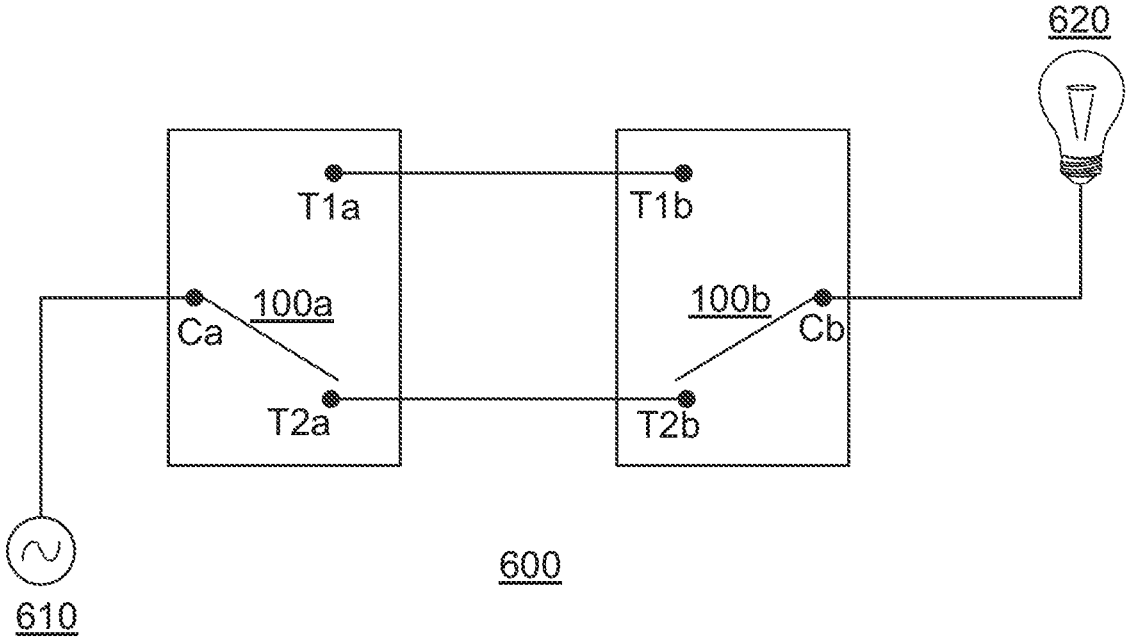
FIG. 13 shows switch modules according to an embodiment of the disclosed subject matter installed in a three-way switch configuration.

FIG. 13 depicts a pair of disclosed switch modules 100*a*, 100*b* installed in a three-way switch configuration 600 in a premises. Switch module 100*a* includes a common terminal Ca and a pair of traveler terminals T1*a*, T2*a*. Similarly, module 100*b* includes a common terminal Cb and a pair of traveler terminals T1*b*, T2*b*. The switch module 100*a* includes a relay circuit that controls a switchable connection between Ca and either of T1*a* or T2*a*. The configuration 600 permits either of switch module 100*a* or 100*b* to control delivery of power from a main source 610 to a load 620 by switching a connection between the common and traveler terminals. Switch modules 100*a*, 100*b* can therefore be installed in separate locations within a premises and both control the load. It should be noted, however, that in configuration 600 only switch module 100*b* (i.e., the switch module with a common terminal connected to the load 620) can optionally operate in either a dimmer mode or a toggle mode.

Figure 14:
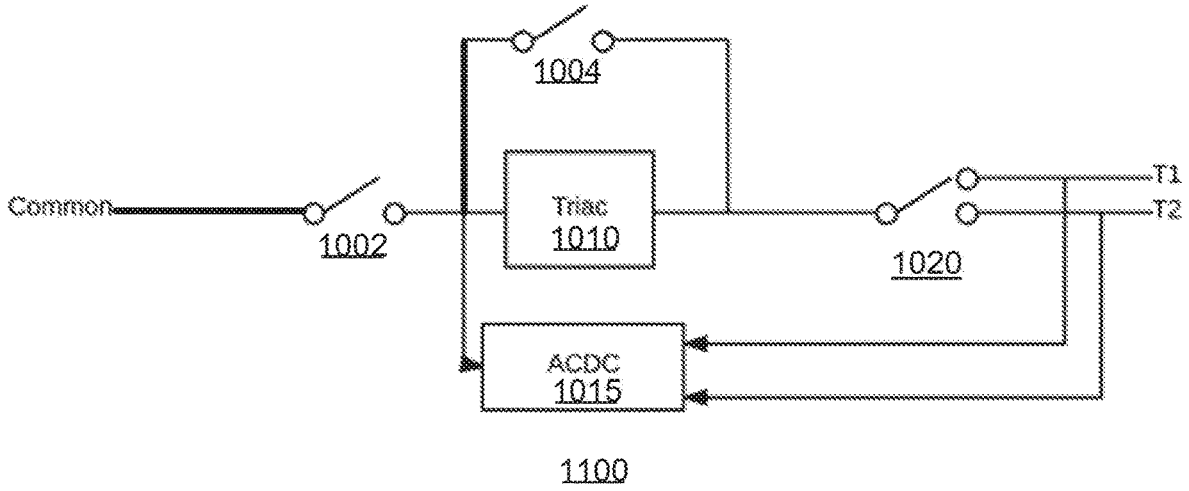
FIG. 14 shows a block diagram of a switch circuit according to an embodiment of the disclosed subject matter.

FIG. 14 depicts a block diagram of a switch circuit 1100 which can be included in an embodiment of the disclosed switch module 100. The switch circuit 1100 includes a first relay 1002, a second relay 1004, a TRIAC 1010, an AC-to-DC converter circuit 1015, and a third relay 1020. It should be understood that additional components can be included in the switch circuit 1100. The setting of the first relay 1002 and second relay 1004 are controlled by the slidable switch 102 and contact assembly 705, as described above. That is, referring to FIGS. 12 and 14, in one configuration first relay 1002, for example, can be opened/closed by slidable switch 102 depressing or releasing wheel 712*a* while second relay 1004 is opened/closed by slidable switch 102 depressing or releasing wheel 712*b*.

Referring to FIGS. 12 and 14, in the position depicted in FIG. 12 (A) wheel 712*a* is depressed, opening first relay 1002 while leaving second relay 1004 closed. In this setting the switch module operates in an 'off' mode. That is, the common terminal is electrically disconnected from TRIAC 1010, ACDC 1015, and relay 1020 by a safety air-gap due to the open relay 1002.

In position (B) neither of wheel 712*a* nor 712*b* are depressed, leaving both the first relay 1002 and the second relay 1004 in a closed state by default. In this setting the switch module operates in a 'toggle' mode. Power received at the common terminal bypasses the TRIAC 1010, which is electrically disabled in this mode. The flow of power passes through and is controlled by third relay 1020.

In position (C) wheel 712*b* is depressed, thereby opening second relay 1004 and leaving first relay 1002 closed. In this setting the switch module operates in a 'dimmer' mode. The common terminal is electrically connected to TRIAC 1010, thereby allow the flow of received power to pass through and be controlled by TRIAC 1010, which functions as a dimming controller of load 620.

The two relays 1002, 1004 and TRIAC 1010 therefore enable either of a toggle or dimmer mode of operation. That is, if the user wishes to control a load using on/off toggle commands without dimming, the user can move the slidable switch to a position to set first relay 1002 and second relay 1004 both closed. If the user wishes to control a load using dimming functionality, the user can move the slidable switch into a position to set first relay 1002 closed and second relay 1004 open. Whenever the user wishes to cease providing power to the load the user can move the slidable switch to a position to set the first relay 1002 open, thereby creating an air gap in the switch circuit 1100 between the common terminal and the load.

Turning now to cooperation between the UI module 400 and the switch module 100, FIGS. 4 and 6 show retention magnets 431, 433 positioned to draw the UI module 400 into alignment with the magnets 135, 137 of the switch module 100. In this manner, the UI module 400 is automatically retained in proper alignment and position with the switch module 100 by the retention force of the magnets.

Figure 15:
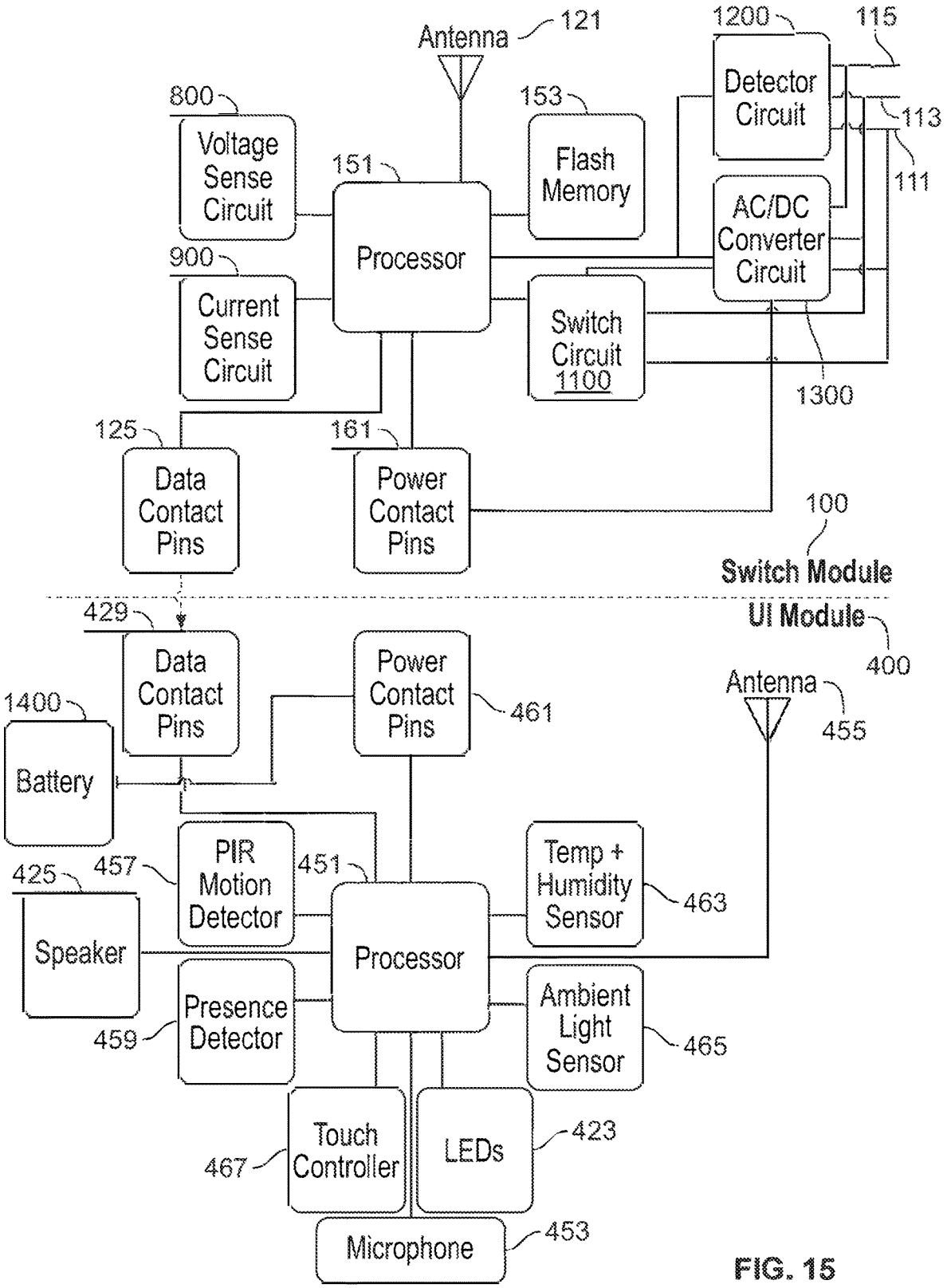
FIG. 15 shows a block diagram of a switch module and UI module according to an embodiment of the disclosed subject matter.

FIG. 15 is a block diagram of the switch module 100 and the UI module 400. The switch module 100 includes a processor 151 which controls functions executed by the switch module 100. The processor 151 may also comprise its own memory, modem and/or other functions to comprise a "system on a chip" (SoC). The switch module 100 can include a Hall Effect sensor (not depicted) connected to the processor 151 and can include one or more secondary processors (not depicted) to handle certain designated functions or to otherwise aid the processor 151. The switch module 100 also powers contact pins 161 that are capable of transmitting power to the UI module 400.

Processor 151 can transmit data and commands to the UI module 400 via data contact pins 125. Data contact pins 125 can be separate from power contact pins 161 or can be one and the same. The switch module 100 can include flash memory 153 external to the processor 151. The switch module 100 also includes an antenna 121 connected to the processor 151. The switch module 100 further includes a switch circuit 1100, detector circuit 1200, and AC-DC converter circuit 1300 connected to and controlled by the processor 151.

The switch circuit 1100 can include, as described above (FIG. 14) relay circuits, a triode for alternating current (TRIAC) circuit, and a multi-position switch that allows a user to choose between use of a relay (toggle mode) and TRIAC (dimmer mode) for controlling the power delivered to a load. The switch module 100 can also include a voltage sense circuit 800 and a current sense circuit 900 to allow the switch module 100 to monitor the power used by the load attached to it.

The UI module 400 has a processor 451 that can be similar to that of the switch module 100. The processor 451 may have additional components and functionality embedded to comprise a SoC. The UI module 400 can include an antenna 455 which allows two way data communication using protocols such as WiFi. Additional antennas and wireless protocols may be implemented as well but are omitted from the illustration for simplification.

The UI module 400 can include data contact pins 429 and power contact pins 461 to receive/transmit data from the processor 451 and to receive power from the switch module 100 to power the UI module 400 components and charge battery 1400. Data contact pins 429 can be separate from power contact pins 461 or can be one and the same. In one implementation the processor 451 can transmit a status request to the switch module 100 to check, for example, which mode the switch module 100 is set in or a state of the load controlled by the switch module 100. Based on the received response, the processor 451 can control the UI module 400 to display an appropriate interface. In this way the UI module 400 can display an interface in accordance with setting of the slidable switch that sets the switch module 100 operational mode.

The UI module 400 also includes a speaker 425 and microphone 453 connected to the processor 451. As previously mentioned, LEDs 423 are included in the UI module 400 and are connected to and controlled by the processor 451 to, for example, display a load status or function as part of an interface. A variety of sensors can be connected to the processor 451, including: temperature and humidity 463, ambient light 465, touch 467, presence 459 and motion 457.

The disclosed smart electrical control system can be a part of a smart-home environment which can include a structure, such as, for example, an apartment, office building, garage, factory, mobile home, or the like. The smart electrical control system can control and/or be connected to devices and systems inside or outside of the structure.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A modular electrical control system configured to be installed in an electrical box of a premises, comprising:

a switch module configured to control power delivery to at least one external load, the switch module comprising three operational modes including an off mode, a toggle mode and a dimmer mode, the switch module further including a multi-position switch device that changes between the three operational modes of the switch module to one of the off mode, the toggle mode or the dimmer mode; and a removable user interface module configured to electrically connect to the switch module, receive power from the switch module, and display an interface in accordance with a setting of the multi-position switch device, wherein the multi-position switch device further comprises a first plunger configured to be depressed in a first plane to disengage a first electrical load between a first set of conducting elements; a second plunger configured to be depressed in the first plane to disengage a second electrical load between a second set of conducting elements; a slidable switch, operable to translate in a second plane orthogonal to the first plane, the slidable switch configured to depress the first plunger when the slidable switch moves in a first direction within the second plane into a first position configured to operate the off mode, depress the second plunger when the slidable switch moves in a second direction, opposite the first direction, into a second position configured to operate the dimmer mode, and move within the second plane into a third position between the first and second positions configured to operate the toggle mode.

2. The modular electrical control system of claim 1, wherein the multi-position switch device comprises:

the first set of conducting elements including a first contact bar biased against a first set of contact pads;

the second set of conducting elements including a second contact bar biased against a second set of contact pads;

the first plunger disposed proximate to the first contact bar such that when the first plunger is depressed the first contact bar is disengaged from the first set of contact pads, leaving a first air gap between the first set of contact pads and the first contact bar;

the second plunger disposed proximate to the second contact bar such that when the second plunger is depressed the second contact bar is disengaged from the second set of contact pads, leaving a second air gap between the second set of contact pads and the second contact bar; and the slidable switch, having a protrusion configured to depress the first plunger when the switch moves into the first position, depress the second plunger when the switch moves into the second position, and not depress the first or second plunger when the switch moves into the third position.

3. The modular electrical control system of claim 2, wherein:

the switch module includes:

a common terminal electrically connected to a power source, and a TRIAC that controls an amount of power configured to be delivered to an external load; and the first contact bar connects the common terminal to the TRIAC when the first contact bar contacts the first contact pads.

4. The modular electrical control system of claim 3, wherein:

the switch module further includes a relay circuit configured to control a flow of power to the external load; and the second contact bar connects the common terminal to the relay circuit when the second contact bar contacts the second set of contact pads and the first contact bar contacts the first set of contact pads.

5. The modular electrical control system of claim 2, wherein the first and second plungers each further comprise a wheel attached on a distal end portion opposite the corresponding first and second sets of contact pads such that when the switch protrusion engages each respective wheel, the switch protrusion causes the respective wheel to turn as the switch moves one of into or out of the first or second position.

6. The modular electrical control system of claim 5, wherein the first and second sets of contact pads and the first and second plungers are disposed within a housing such that the wheels protrude out of a first side of the housing.

7. The modular electrical control system of claim 6, wherein the housing further includes:

an assembly cover attached to a second side of the housing opposite the first side, the assembly cover having a first channel and a second channel that receives the first and second plungers;

the bias of the first and second sets of contact pads against the first and second contact bars is maintained by a force applied to the first and second contact bars by first and second coil springs; and the first and second channels each have edge portions that extend inward and engage extension portions of the plungers respectively to prevent the force exerted by the coil springs from causing the plungers to exit the respective channels in a first direction.

8. The modular electrical control system of claim 6, wherein the housing includes a first and second opening on the first side through which the first and second plungers pass through, the first and second openings being configured in a shape to conform with a corresponding shape of a portion of the first and second plungers, the corresponding shape configured to prevent the first and second plungers from rotating as they pass through the first and second openings.

9. The modular electrical control system of claim 6, wherein the housing includes a plurality of holes that release heat accumulated in the housing.

10. The modular electrical control system of claim 7, wherein the housing includes an insulator layer disposed between the assembly cover and each of the first and second contact bars.

11. A multi-position switch device, comprising: a first spring-loaded contact bar biased against a first set of contact pads; a second spring-loaded contact bar biased against a second set of contact pads; a first plunger disposed proximate to the first spring-loaded contact bar such that when the first plunger is depressed in a first plane, the first spring-loaded contact bar disengages from the first set of contact pads leaving a first air gap between the first set of contact pads and the first spring-loaded contact bar; a second plunger disposed proximate to the second spring-loaded contact bar such that when the second plunger is depressed in the first plane, the second spring-loaded contact bar disengages from the second set of contact pads leaving a second air gap between the second set of contact pads and the second spring-loaded contact bar; and a slidable switch, operable to translate in a second plane orthogonal to the first plane, the slidable switch having a protrusion configured to depress the first plunger when the switch moves in a first direction within the second plane into a first position configured to operate an off mode, depress the second plunger when the switch moves in a second direction within the second plane, opposite the first direction, into a second position configured to operate a dimmer mode, and not depress the first and second plunger when the switch moves into a third position between the first and second positions, the third position configured to operate a toggle mode.

12. The multi-position switch device of claim 11, wherein the first and second plungers each further comprise a wheel attached on a distal end portion opposite the corresponding first and second sets of contact pads such that when the switch protrusion engages each respective wheel, the switch protrusion causes the respective wheel to turn as the switch moves one of into or out of the first or second position.

13. The multi-position switch device of claim 12, wherein the first and second sets of contact pads and the first and second plunger are disposed within a housing such that the wheels protrude out of a first side of the housing.

14. The multi-position switch device of claim 13, wherein the housing further includes:

an assembly cover attached to a second side of the housing opposite the first side, the assembly cover having a first channel and a second channel that receives the first and second plungers; and the first and second channels each have having edge portions that extend inward and engage extension portions of the respective plungers to prevent a force exerted by coil springs from causing the plungers to exit the respective channels in a first direction.

15. The multi-position switch device of claim 13, wherein the housing includes a first and second opening on the first side through which the first and second plungers pass through, the first and second openings being configured in a shape to confirm with a corresponding shape of a portion of the first and second plungers, the corresponding shape configured to prevent the first and second plungers from rotating as they pass through the first and second openings.

16. The multi-position switch device of claim 13, wherein the housing includes a plurality of holes that release heat accumulated in the housing.

17. The multi-position switch device of claim 13, wherein the housing includes an insulator layer disposed between the assembly cover and each of the first and second contact bars.

18. A modular electrical control system for installation in an electrical box of a premises, comprising:

a switch module configured to control power delivery to at least one external load, the switch module including a multi-position switch device that changes an operational mode of the switch module to off, toggle mode or dimmer mode;

a removable user interface module configured to physically and electrically connect to the switch module, receive power from the switch module, and display, under the power received from the switch module, an interface in accordance with a setting of the multi-position switch device;

a first plunger disposed proximate a first contact bar biased against a first set of contact pads such that when the first plunger is depressed the first contact bar is disengaged from the first set of contact pads;

a second plunger disposed proximate a second contact bar biased against a second set of contact pads such that when the second plunger is depressed the second contact bar is disengaged from the second set of contact pads; and a slidable switch protrusion configured to depress a first wheel attached on a first distal end portion of the first plunger opposite the corresponding first set of contact pads when the slidable switch protrusion moves into a first position configured to operate the off mode, and depress a second wheel attached on a second distal end portion of the second plunger opposite the corresponding second set of contact pads when the slidable switch protrusion moves into a second position configured to operate the dimmer mode.

19. A multi-position switch device, comprising:

a first spring-loaded contact bar biased against a first set of contact pads;

a second spring-loaded contact bar biased against a second set of contact pads;

a first plunger disposed proximate to the first spring-loaded contact bar such that when the first plunger is depressed the first spring-loaded contact bar disengages from the first set of contact pads leaving an air gap between the first set of contact pads and the first contact bar;

a second plunger disposed proximate to the second spring-loaded contact bar such that when the second plunger is depressed the second spring-loaded contact bar disengages from the second set of contact pads leaving an air gap between the second set of contact pads and the second spring-loaded contact bar; and a slidable switch, having a protrusion that depresses the first plunger when the switch passes into a first position, depresses the second plunger when the switch moves into a second position, and does not depress the first and second plunger when the switch moves into a third position, wherein the first and second plungers each have a wheel attached on a distal end portion opposite the corresponding set of contact pads such that the switch protrusion engages each wheel and causes the wheel to turn as the switch moves into or out of the first or second position.

* * * * *